US009030451B2

(12) United States Patent
Lee et al.

(10) Patent No.: US 9,030,451 B2
(45) Date of Patent: May 12, 2015

(54) DISPLAY DRIVING CIRCUIT, DISPLAY APPARATUS HAVING THE SAME AND METHOD OF DRIVING THE SAME

(71) Applicant: Samsung Display Co., Ltd., Yongin, Gyeonggi-Do (KR)

(72) Inventors: Jae-Han Lee, Hwaseong-si (KR); Sunkyu Son, Suwon-si (KR); Sun-Koo Kang, Seoul (KR)

(73) Assignee: Samsung Display Co., Ltd. (KR)

( * ) Notice: Subject to any disclaimer, the term of this patent is extended or adjusted under 35 U.S.C. 154(b) by 278 days.

(21) Appl. No.: 13/778,414

(22) Filed: Feb. 27, 2013

(65) Prior Publication Data

US 2014/0035897 A1 Feb. 6, 2014

(30) Foreign Application Priority Data

Jul. 31, 2012 (KR) ..... 10-2012-0084060

(51) Int. Cl.
*G09G 5/00* (2006.01)
*G09G 3/36* (2006.01)

(52) U.S. Cl.
CPC ..... *G09G 3/3696* (2013.01); *G09G 3/3614* (2013.01); *G09G 3/3685* (2013.01)

(58) Field of Classification Search
CPC ... G09G 3/36; G09G 3/3614; G09G 3/36856; G09G 3/3696; G09G 5/00; G09G 2310/0264; H03M 1/66
See application file for complete search history.

(56) References Cited

U.S. PATENT DOCUMENTS

| | | | | |
|---|---|---|---|---|
| 5,311,145 | A | 5/1994 | Huijsing et al. | |
| 5,631,607 | A | 5/1997 | Huijsing et al. | |
| 6,366,167 | B1 | 4/2002 | Stockstad | |
| 6,556,162 | B2 * | 4/2003 | Brownlow et al. | 341/145 |
| 6,614,307 | B1 | 9/2003 | Zhao et al. | |
| 7,088,178 | B1 | 8/2006 | Rosenfeld et al. | |
| 7,164,317 | B1 | 1/2007 | Lorenz | |
| 7,626,445 | B2 | 12/2009 | Lesso et al. | |
| 7,868,805 | B2 * | 1/2011 | Choi | 341/144 |
| 2005/0030681 | A1 | 2/2005 | Rosenthal | |
| 2005/0068286 | A1 * | 3/2005 | Morita | 345/100 |
| 2007/0139328 | A1 * | 6/2007 | Lan | 345/89 |
| 2010/0033458 | A1 * | 2/2010 | Shimizu et al. | 345/211 |
| 2010/0182299 | A1 * | 7/2010 | Hyoudou et al. | 345/211 |
| 2011/0169801 | A1 * | 7/2011 | Hsieh et al. | 345/211 |
| 2011/0169814 | A1 * | 7/2011 | Van Ess et al. | 345/212 |

(Continued)

FOREIGN PATENT DOCUMENTS

| | | | |
|---|---|---|---|
| KR | 1020020035324 | A | 5/2002 |
| KR | 1020050040118 | A | 5/2005 |

(Continued)

*Primary Examiner* — Joe H Cheng
(74) *Attorney, Agent, or Firm* — Cantor Colburn LLP

(57) ABSTRACT

A display driving circuit includes a digital-to-analog converter configured to convert a digital image signal to an analog image signal, and a buffer circuit configured to receive the analog image signal and to output an output signal to be applied to a data line, where the buffer circuit includes an input stage configured to receive the analog image signal and to output a first signal, a first output stage configured to receive a first voltage and a second voltage and to output the output signal, a second output stage configured to receive a third voltage and a fourth voltage and to output the output signal, and a selection circuit configured to apply the first signal from the input stage to the first output stage or the second output stage in response to a mode signal.

18 Claims, 14 Drawing Sheets

(56) References Cited

U.S. PATENT DOCUMENTS

| | | | | |
|---|---|---|---|---|
| 2011/0175863 | A1* | 7/2011 | Shin | 345/204 |
| 2012/0032944 | A1 | 2/2012 | Kojima | |
| 2012/0162272 | A1* | 6/2012 | Lee et al. | 345/690 |

FOREIGN PATENT DOCUMENTS

| | | | |
|---|---|---|---|
| KR | 1020060076862 | A | 7/2006 |
| KR | 1020090012811 | A | 2/2009 |
| KR | 1020110119309 | A | 11/2011 |

* cited by examiner

DISPLAY DRIVING CIRCUIT, DISPLAY APPARATUS HAVING THE SAME AND METHOD OF DRIVING THE SAME

This application claims priority to Korean Patent Application No. 10-2012-0084060, filed on Jul. 31, 2012, and all the benefits accruing therefrom under 35 U.S.C. §119, the content of which in its entirety is herein incorporated by reference.

BACKGROUND

1. Field

The disclosure relates to a display driving circuit and a display apparatus including the display driving circuit.

2. Description of the Related Art

A display driving circuit that drives a display panel of a display apparatus is generally designed based on display characteristics of the display panel, e.g., a driving method of the display panel.

Among display apparatuses, a liquid crystal display includes two substrates facing each other and a liquid crystal layer disposed between the two substrates. When two electrodes respectively disposed on the two substrates are applied with voltages, an electric field is generated in the liquid crystal layer due to an electric potential difference between the two electrodes, and an arrangement of liquid crystal molecules of the liquid crystal layer is changed. In the liquid crystal display, a direction of the electric field is typically periodically changed to prevent electrical and physical properties of the liquid crystal layer from being deteriorated, which may occur when the electric field is applied to the liquid crystal layer constantly in one direction.

To change the direction of the electric field, an inversion driving method, such as a frame inversion method in which a polarity of pixels is inverted in the unit of a frame, a line inversion method in which the polarity of pixels is inverted in the unit of a line, a dot inversion method in which the polarity of pixels is inverted in the unit of a pixel, for example, is widely used. However, different display driving circuits are typically used for the various inversion driving methods.

SUMMARY

Exemplary embodiments of the invention provide a display driving circuit having an output buffer to be driven in various driving modes.

Exemplary embodiments of the invention provide a display apparatus having the display driving circuit.

In an exemplary embodiment of the invention, a display driving circuit includes a digital-to-analog converter configured to convert a digital image signal to an analog image signal, and a buffer circuit configured to receive the analog image signal and to output an output signal to be applied to a data line. In such an embodiment, the buffer circuit includes an input stage configured to receive the analog image signal and to output a first signal, a first output stage configured to receive a first voltage and a second voltage and to output the output signal, a second output stage configured to receive a third voltage and a fourth voltage and to output the output signal, and a selection circuit configured to apply the first signal from the input stage to the first output stage or the second output stage in response to a mode signal.

In an exemplary embodiment, the selection circuit applies the first signal to the first output stage when the mode signal indicates a first mode, the first voltage is a source voltage when the mode signal indicates the first mode, and the second, third and fourth voltages are a ground voltage when the mode signal indicates the first mode.

In an exemplary embodiment, the selection circuit may alternately apply the first signal to the first output stage and the second output stage when the mode signal indicates a second mode, the first voltage may be a source voltage when the mode signal indicates the second mode, the fourth voltage may be a ground voltage when the mode signal indicates the second mode, and the second and third voltages may have a voltage level between the source voltage and the ground voltage when the mode signal indicates the second mode.

In an exemplary embodiment, the selection circuit may alternately apply the first signal to the first output stage and the second output stage in response to a polarity inversion signal when the mode signal indicates the second mode.

In an exemplary embodiment, the first mode may be a column inversion mode, and the second mode may be a dot inversion mode.

In an exemplary embodiment, the digital-to-analog converter may convert the digital image signal to a positive polarity analog image signal and a negative polarity analog image signal and apply one of the positive polarity analog image signal and the negative polarity analog image signal to the input stage in response to a polarity inversion signal.

In an exemplary embodiment, the first signal output from the input stage may include a first differential signal and a second differential signal.

In an exemplary embodiment, the first output stage may include a first transistor connected between the first voltage and an output node and which receives the first differential signal, and a second transistor connected between the output node and the second voltage and which receives the second differential signal. The second output stage may include a third transistor connected between the third voltage and the output node and which receives the first differential signal, and a fourth transistor connected between the output node and the fourth voltage and which receives the second differential signal.

In an exemplary embodiment, the buffer circuit may further include a switching circuit connected between the output node and the data line and which operates in response to a line latch signal.

In another exemplary embodiment of the invention, a display apparatus includes a plurality of gate lines, a plurality of data lines crossing the gate lines, a plurality of pixels connected to the gate lines and the data lines, a gate driver configured to drive the gate lines, a data driver configured to drive the data lines, and a timing controller configured to control the gate driver and the data driver in response to a first image signal and a control signal from an external device and applies a second image signal to the data driver. The data driver includes a digital-to-analog converter configured to convert a digital image signal to an analog image signal and a buffer circuit configured to receive the analog image signal and to output an output signal to the data lines. The buffer circuit includes an input stage configured to receive the analog image signal and to output a first signal, a first output stage configured to receive a first voltage and a second voltage and to output the output signal, a second output stage configured to receive a third voltage and a fourth voltage and to output the output signal, and a selection circuit configured to apply the first signal from the input stage to the first output stage or the second output stage in response to a mode signal.

In an exemplary embodiment, the display apparatus may further include a voltage generator configured to generate the first, second, third and fourth voltages.

In an exemplary embodiment, the selection circuit may apply the first signal to the first output stage when the mode signal indicates a first mode, the first voltage generated by the voltage generator may be a source voltage when the mode signal indicates the first mode, and the second, third and fourth voltages generated by the voltage generator may be a ground voltage when the mode signal indicates the first mode.

In an exemplary embodiment, the selection circuit alternately applies the first signal to the first output stage and the second output stage when the mode signal indicates a second mode, the first voltage may be a source voltage when the mode signal indicates the second mode, the fourth voltage may be a ground voltage when the mode signal indicates the second mode, and the second and third voltages may have a voltage level between the source voltage and the ground voltage when the mode signal indicates the second mode.

In an exemplary embodiment, the selection circuit may alternately apply the first signal to the first output stage and the second output stage in response to a polarity inversion signal when the mode signal indicates the second mode.

In another exemplary embodiment of the invention, a method of driving a display driving circuit includes converting a digital image signal to an analog image signal, receiving the analog image signal to output a first signal, applying the first signal to a first output stage or a second output stage in response to a mode signal, outputting an output signal corresponding to the first signal using the first output stage when the first signal is applied to the first output stage, and outputting an output signal corresponding to the first signal using the second output stage when the first signal is applied to the second output stage. The output signal output from the first output stage has a voltage level between a first voltage and a second voltage, and the output signal output from the second output stage has a voltage level between a third voltage and a fourth voltage.

In an exemplary embodiment, the applying the first signal to the first output stage or the second output stage may include applying the first signal to the first output stage when the mode signal indicates a first mode, where the first voltage may be a source voltage when the mode signal indicates the first mode, and the second, third and fourth voltages may be a ground voltage when the mode signal indicates the first mode.

In an exemplary embodiment, the applying the first signal to the first output stage or the second output stage may include alternately applying the first signal to the first output stage and the second output stage when the mode signal indicates a second mode, where the first voltage may be the source voltage when the mode signal indicates the second mode, the fourth voltage may be the ground voltage when the mode signal indicates the second mode, and the second and third voltages may have a voltage level between the source voltage and the ground voltage when the mode signal indicates the second mode.

In an exemplary embodiment, the alternately applying the first signal to the first output stage and the second output stage when the mode signal indicates the second mode is performed in response to a polarity inversion signal.

According to one or more exemplary embodiment, the display driving circuit may be operated in various modes. In such an embodiment, the display driving circuit may be employed to various display apparatuses regardless of the driving mode of the display panel of the display apparatuses, such that a manufacturing cost of the display apparatus is substantially reduced.

BRIEF DESCRIPTION OF THE DRAWINGS

The above and other features of the invention will become readily apparent by reference to the following detailed description when considered in conjunction with the accompanying drawings of which.

DETAILED DESCRIPTION

Figure 1:
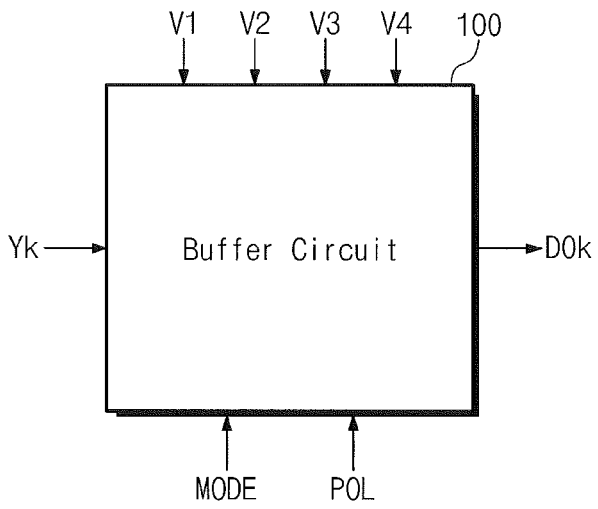
FIG. 1 is a block diagram showing an exemplary embodiment of a buffer circuit according to the invention.

The invention will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims set forth herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments of the invention will be explained in detail with reference to the accompanying drawings.

FIG. 1 is a block diagram showing an exemplary embodiment of a buffer circuit according to the invention.

Referring to FIG. 1, a buffer circuit 100 receives first, second, third and fourth driving voltages V1, V2, V3 and V4. The buffer circuit 100 receives an input signal Yk and outputs an output signal DOk in response to a mode signal MODE and a polarity inversion signal POL from an external source (not shown).

Figure 2:
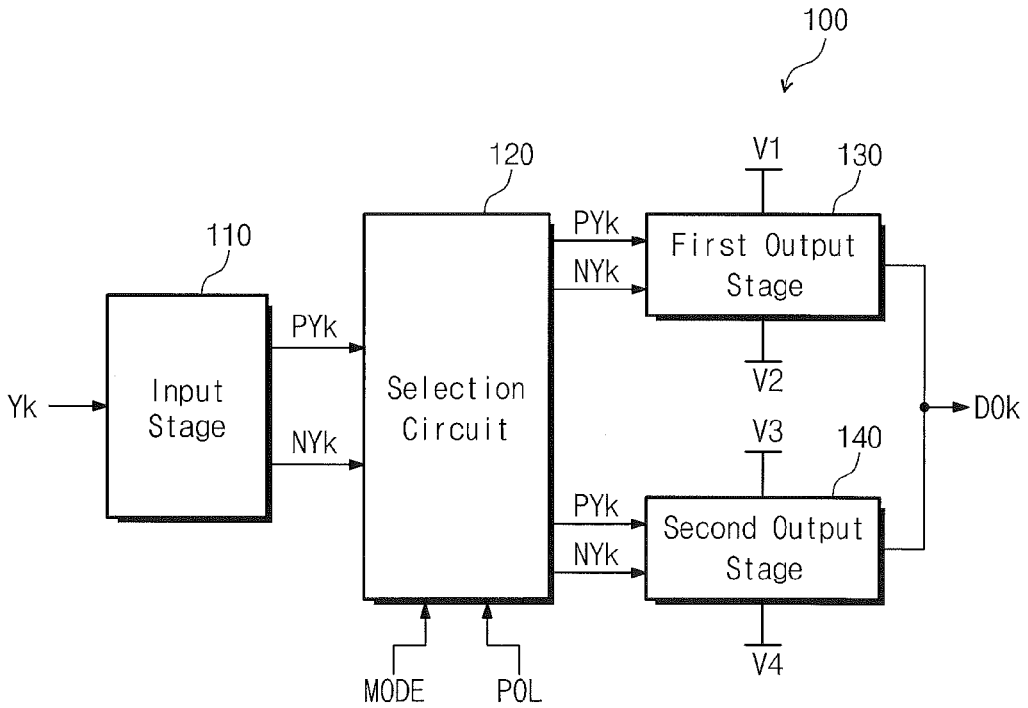
FIG. 2 is a block diagram showing a configuration of an exemplary embodiment of the buffer circuit shown in FIG. 1.

FIG. 2 is a block diagram showing a configuration of an exemplary embodiment of the buffer circuit shown in FIG. 1.

Referring to FIG. 2, the buffer circuit 100 includes an input stage 110, a selection circuit 120, a first output stage 130 and a second output stage 140. The input stage 110 receives the input signal Yk and outputs a first signal. The first signal includes first and second differential signals PYk and NYk. The first differential signal PYk is a non-inversion differential signal and the second differential signal NYk is an inversion differential signal.

The selection circuit 120 applies the first and second differential signals PYk and NYk to one of the first and second output stages 130 and 140 in response to the mode signal MODE and the polarity inversion signal POL. In an exemplary embodiment, the selection circuit 120 applies the first and second differential signals PYk and NYk to the first output stage 130 when the mode signal MODE indicates a first mode. In such an embodiment, when the mode signal MODE indicates a second mode, the selection circuit 120 alternately applies the first and second differential signals PYk and NYk to the first output stage 130 and the second output stage 140 in response to the polarity inversion signal POL.

The first output stage 130 receives the first driving voltage V1 and the second driving voltage V2 and outputs the output signal DOk corresponding to the first and second differential signals PYk and NYk provided from the input stage 110 through the selection circuit 120. The second output stage 140 receives the third driving voltage V3 and the fourth driving voltage V4 and outputs the output signal DOk corresponding to the first and second differential signals PYk and NYk provided from the input stage 110 through the selection circuit 120.

In one exemplary embodiment, for example, in the first mode, the first driving voltage V1 applied to the first output stage 130 is a source voltage and the second driving voltage V2 applied to the first output stage 130 is a ground voltage. In such an embodiment, in the second mode, the first driving voltage V1 applied to the first output stage 130 is the source voltage and the fourth driving voltage V4 applied to the second output stage 140 is the ground voltage. The second driving voltage V2 applied to the first output stage 130 and the third driving voltage V3 applied to the second output stage 140 have a voltage level between the source voltage and the ground voltage. The second driving voltage V2 and the third driving voltage V3 may have a same voltage level.

Figure 3:
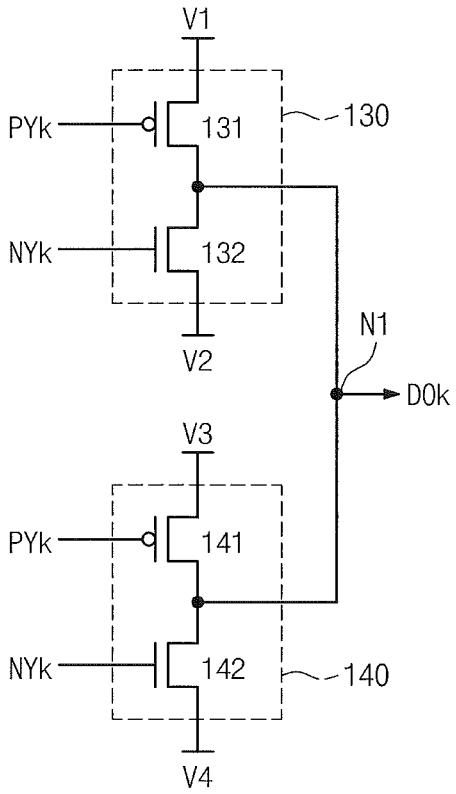
FIG. 3 is a circuit diagram showing a circuit configuration of first and second output stages shown in FIG. 2.

FIG. 3 is a circuit diagram showing an exemplary embodiment of a circuit configuration of the first and second output stages shown in FIG. 2.

Referring to FIG. 3, the first output stage 130 includes a first transistor 131 and a second transistor 132. The first transistor 131 is connected between the first driving voltage V1 and an output node N1 and includes a gate terminal which receives the first differential signal PYk. The second transistor 132 is connected between the second driving voltage V2 and the output node N1 and includes a gate terminal which receives the second differential signal NYk.

The second output stage 140 includes a third transistor 141 and a fourth transistor 142. The third transistor 141 is connected between the third driving voltage V3 and the output node N1 and includes a gate terminal which receives the first differential signal PYk. The fourth transistor 142 is connected between the fourth driving voltage V4 and the output node N1 and includes a gate terminal which receives the second differential signal NYk. The output signal DOk is output through the output node N1.

Referring again to FIG. 2, the first output stage 130 receives the first and second differential signals PYk and NYk output from the input stage 110 in the first mode and outputs the output signal DOk having the voltage level between the first driving voltage V1 and the second driving voltage V2.

In an exemplary embodiment, when the polarity inversion signal POL is at a first level, e.g., a high level, in the second mode, the first output stage 130 receives the first and second differential signals PYk and NYk output from the input stage 110 and outputs the output signal DOk having the voltage level between the first driving voltage V1 and the second driving voltage V2. When the polarity inversion signal POL is at a second level, e.g., a low level, in the second mode, the second output stage 140 receives the first and second differential signals PYk and NYk output from the input stage 110 and outputs the output signal DOk having the voltage level between the third driving voltage V3 and the fourth driving voltage V4.

As described above, an exemplary embodiment of the buffer circuit 100 may operate not only in the first mode but also in the second mode. Therefore, the buffer circuit 100 may be applied to a device that operates both in the first mode and in the second mode.

Figure 4:
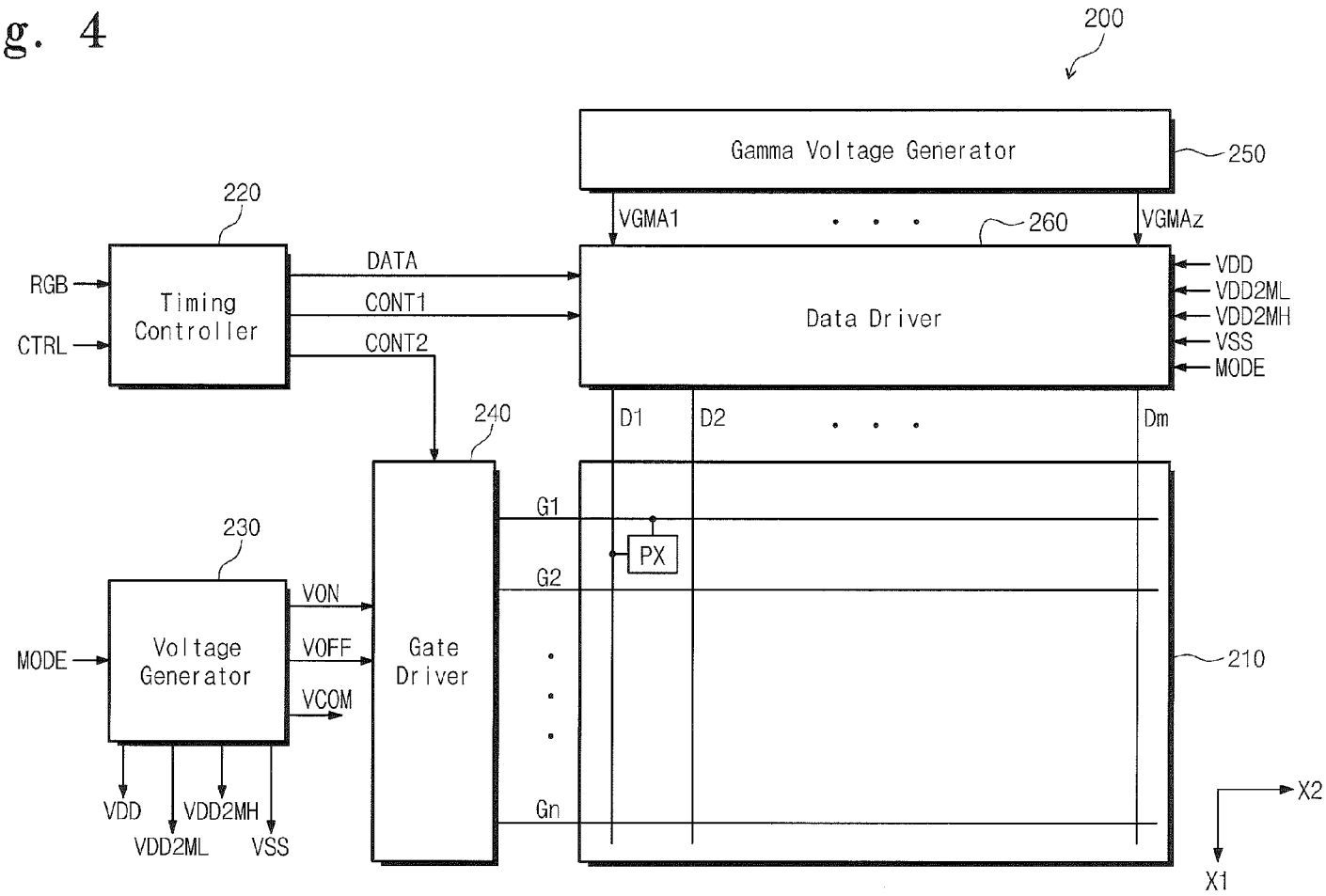
FIG. 4 is block diagram showing an exemplary embodiment of a display apparatus according to the invention.

FIG. 4 is block diagram showing an exemplary embodiment of a display apparatus according to the invention. Hereinafter, for convenience of description, an exemplary embodiment where the display apparatus is a liquid crystal display will be described, but the display apparatus is not be limited to the liquid crystal display.

Referring to FIG. 4, a display apparatus 200 includes a display panel 210, a timing controller 220, a voltage generator 230, a gate driver 240, a gamma voltage generator 250 and a data driver 260.

The display panel 210 includes a plurality of data lines D1 to Dm that extends in a first direction X1, a plurality of gate lines G1 to Gn that extends in a second direction X2 to cross the data lines D1 to Dm, and a plurality of pixels PX arranged substantially in a matrix form. The pixels PX are connected to the gate lines G1 to Gn and the data lines D1 to Dm. In one exemplary embodiment, the pixels PX may be associated with areas defined by the data lines D1 to Dm and the gate lines G1 to Gn, which are crossing each other, but is not limited thereto or thereby. The data lines D1 to Dm are insulated from the gate lines G1 to Gn.

Although not shown in FIG. 4, each pixel includes a switching transistor connected to a corresponding data line of the data lines D1 to Dm and a corresponding gate line of the gate lines G1 to Gn, a liquid crystal capacitor connected to the switching transistor, and a storage capacitor connected to the switching transistor.

The timing controller 220 receives image signals RGB and control signals CTRL, e.g., a vertical synchronization signal, a horizontal synchronization signal, a main clock signal, a data enable signal, etc., to control the image signals RGB. The timing controller 220 converts the image signal RGB to image data DATA corresponding to an operation condition of the display panel 210 based on the control signals CTRL. The timing controller 220 applies the image data DATA and a first control signal CONT1 to the data driver 260 and applies a second control signal CONT2 to the gate driver 240. The first control signal CONT1 includes a first start pulse signal, a clock signal CLK, a polarity inversion signal POL and a line latch signal LOAD (shown in FIG. 5), and the second control signal CONT2 includes a vertical synchronization start signal, an output enable signal, and a gate pulse signal.

The voltage generator 230 generates a gate-on voltage VON, a gate-off voltage VOFF, and a common voltage VCOM, which are used to drive the display panel 210. The voltage generator 230 generates a first driving voltage VDD, a second driving voltage VDD2ML, a third driving voltage VDD2MH and a fourth driving voltage VSS in response to the mode signal MODE, which are used to drive the data driver 260. The mode signal MODE is provided from an external device of the display apparatus 200. In one exemplary embodiment, for example, the voltage generator 230 of the display apparatus 200 receives the mode signal MODE from a host (not shown). In an alternative exemplary embodiment, the mode signal MODE may be applied to the timing controller 220 together with the control signals CTRL from the host, and then the timing controller 220 may apply the mode signal MODE to the voltage generator 230. The gate driver 240 drives the gate lines G1 to Gn in response to the second control signal CONT2 from the timing controller 220 and the gate-on and gate-off voltages VON and VOFF from the voltage generator 230. In an exemplary embodiment, the gate driver 240 includes a gate driver integrated circuit ("IC"), but the gate driver 240 should not be limited to the gate driver IC. In an exemplary embodiment, the gate driver 240 may be configured to include a circuit including oxide semiconductor, amorphous semiconductor, crystalline semiconductor or polycrystalline semiconductor.

The gamma voltage generator 250 generates a plurality of gamma voltages VGMA1 to VGMAz.

In an exemplary embodiment, the data driver 260 drives the data lines D1 to Dm using the gamma voltages VGMA1 to VGMAz in response to the image data DATA and the first control signal CONT1. In such an embodiment, the data driver 260 receives the first driving voltage VDD, the second driving voltage VDD2ML, the third driving voltage VDD2MH and the fourth driving voltage VSS generated by the voltage generator 230 and operates in one of the first mode and the second mode in response to the mode signal MODE. The operation of the data driver 260 will be described later in detail.

When the gate-on voltage VON is applied to one gate line by the gate driver 240, switching transistors arranged in one row and connected to the one gate line are turned on. The data driver 260 provides gray-scale voltages corresponding to the image data DATA to the data lines D1 to Dm. The gray-scale voltages applied to the data lines D1 to Dm are applied to corresponding liquid crystal capacitors and corresponding storage capacitors through the turned-on switching transistors. A period in which the switching transistors corresponding to one row are turned on, e.g., one period of the data enable signal, is referred to as "one horizontal period" or "1H".

The display panel 210 may operate in various inversion modes, e.g., a frame inversion method in which a polarity of pixels is inverted in the unit of a frame, a line inversion method in which the polarity of pixels is inverted in the unit of one horizontal period, a one-by-one dot inversion method in which the polarity of pixels is inverted in the unit of a pixel, a two-by-one or one-by-two dot inversion method in which the polarity of pixels is inverted in the unit of two lines, etc. In response to the mode signal MODE, the data driver 260 drives the data lines D1 to Dm with signals corresponding to the inversion mode of the display panel 210.

Figure 5:
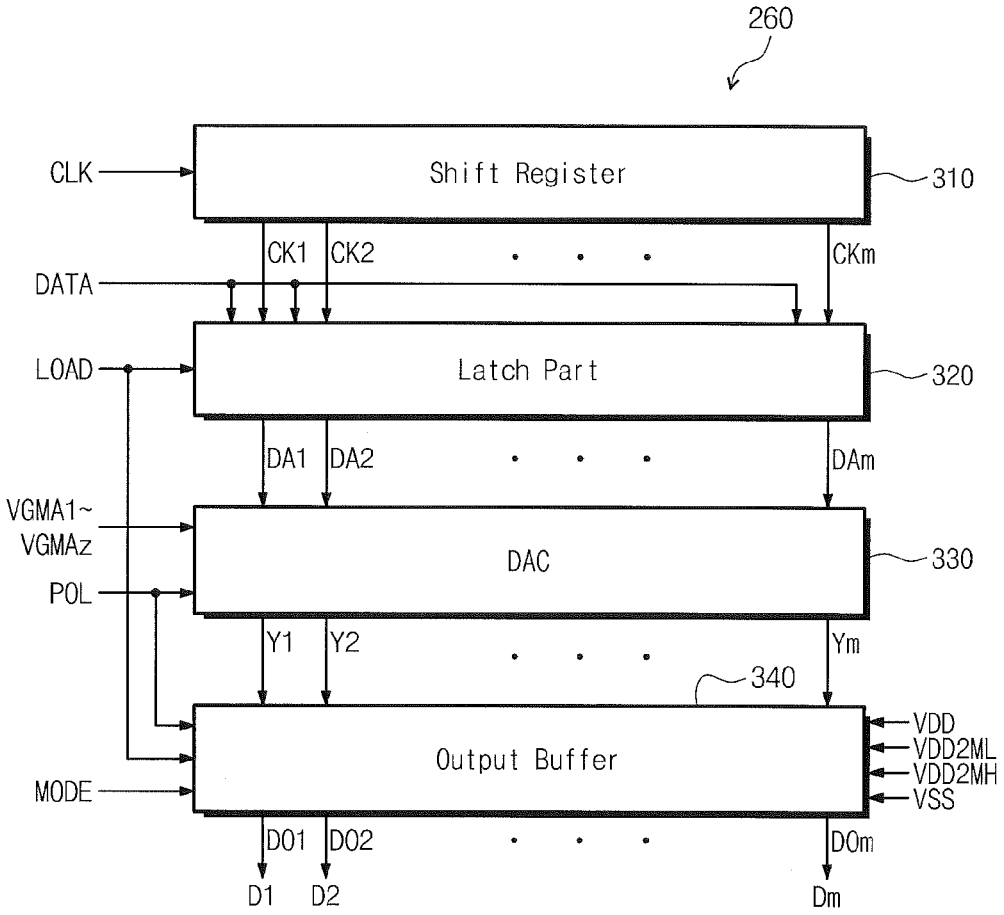
FIG. 5 is a block diagram showing an exemplary embodiment of a data driver shown in FIG. 4.

FIG. 5 is a block diagram showing an exemplary embodiment of a data driver shown in FIG. 4.

Referring to FIG. 5, the data driver 260 includes a shift register 310, a latch part 320, a digital-to-analog converter 330 (DAC in FIG. 5, and hereinafter, referred to as "DA converter") and an output buffer 340.

In FIG. 5, the clock signal CLK, the polarity inversion signal POL and a line latch signal LOAD are included in the first control signal CONT1 from the timing controller 220 shown in FIG. 4.

The shift register 310 sequentially activates latch clock signals CK1 to CKm in synchronization with the clock signal CLK. The latch part 320 latches the image data DATA in synchronization with the latch clock signals CK1 to CKm from the shift register 310 and simultaneously applies latch image signals DA1 to DAm to the DA converter 330 in response to the line latch signal LOAD.

The DA converter 330 receives the gamma voltages VGMA1 to VGMAz from the gamma voltage generator 250 shown in FIG. 4 and outputs gamma voltages corresponding to the latch image signals DA1 to DAm from the latch part 320 to the output buffer 340 as analog image signals Y1 to Ym in response to the polarity inversion signal POL.

In response to the line latch signal LOAD, the polarity inversion signal POL and the mode signal MODE, the output buffer 340 outputs output signals DO1 to DOm respectively corresponding to the analog image signals Y1 to Ym from the DA converter 330 to drive the data lines D1 to Dm.

In such an embodiment, the output buffer 340 receives the first, second, third and fourth driving voltages VDD, VDD2ML, VDD2MH and VSS from the voltage generator 230 shown in FIG. 4 and outputs the output signals DO1 to DOm each having the voltage level corresponding to the inversion mode indicated by the mode signal MODE.

Figure 6:
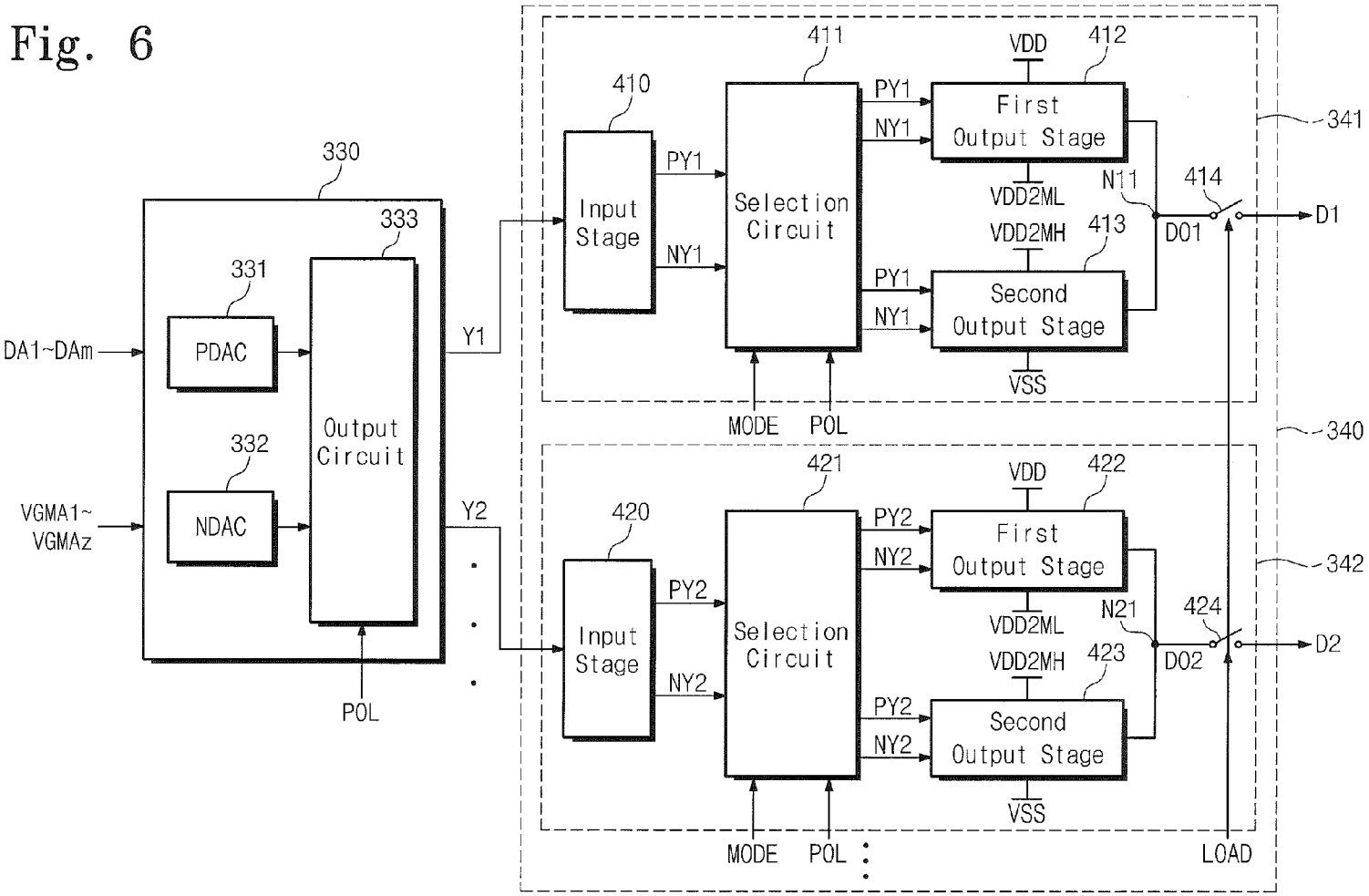
FIG. 6 is a block diagram showing an exemplary embodiment of a digital-to-analog converter and an output buffer shown in FIG. 5.

FIG. 6 is a block diagram showing an exemplary embodiment of a digital-to-analog converter and an output buffer shown in FIG. 5.

Referring to FIG. 6, the DA converter 330 includes a non-inverting DA converter 331 (PDAC in FIG. 6), an inverting DA converter 332 (NDAC in FIG. 6) and an output circuit 333. The non-inverting DA converter 331 outputs non-inverting analog image signals respectively corresponding to the latch image signals DA to DAm from the latch part 320 shown in FIG. 5 based on the gamma voltages VGMA1 to VGMAz. The inverting DA converter 332 outputs inverting analog image signals respectively corresponding to the latch image signals DA to DAm from the latch part 320 shown in FIG. 5 based on the gamma voltages VGMA1 to VGMAz. The output circuit 333 outputs one of the non-inverting analog image signals from the non-inverting DA converter 331 and the inverting analog image signals from the inverting DA converter 332 as the analog image signals Y1 to Ym in response to the polarity inversion signal POL. In one exemplary embodiment, for example, when the polarity inversion signal POL is at the first level, e.g., a high level, the output circuit 333 outputs the non-inverting analog image signals from the non-inverting DA converter 331 as the analog image signals Y1 to Ym, and when the polarity inversion signal POL is at the second level, e.g., a low level, the output circuit 333 outputs the inverting analog image signals from the inverting DA converter 332 as the analog image signals Y1 to Ym.

The output buffer 340 includes buffer circuits 341 and 342. In FIG. 6, only two output buffer circuits, e.g., a first buffer circuit 341 and a second buffer circuit 342, are shown in the output buffer 340, for convenience of illustration, but the number of the buffer circuits may correspond to the number of the data lines D1 to Dm. The buffer circuits are configured to have the same circuit construction and function as each other, and thus only the first buffer circuit 341 will be described in detail for convenience of description.

The first buffer circuit 341 includes an input stage 410, a selection circuit 411, a first output stage 412, a second output stage 413 and a switch 414. Similarly, the second buffer circuit 342 includes an input stage 420, a selection circuit 421, a first output stage 422, a second output stage 423 and a switch 424.

The input stage 410 of the first buffer circuit 341 receives a corresponding analog image signal, e.g., a first analog image signal Y1, and outputs the first signal. The first signal includes the first and second differential signals PYk and NYk. The first differential signal PYk is the non-inversion differential signal and the second differential signal NYk is the inversion differential signal.

The selection circuit 411 of the first buffer circuit 341 applies the first and second differential signals PYk and NYk to one of the first and second output stages 412 and 413 in response to the mode signal MODE and the polarity inversion signal POL. The selection circuit 411 of the first buffer circuit 341 applies the first and second differential signals PYk and NYk to the first output stage 412 when the mode signal MODE indicates the first mode. When the mode signal MODE indicates the second mode, the selection circuit 411 of the first buffer circuit 341 alternately applies the first and second differential signals PYk and NYk to the first output stage 412 of the first buffer circuit 341 and the second output stage 413 of the first buffer circuit 341 in response to the polarity inversion signal POL. The first mode includes a line inversion, a mode in which the polarity of pixels is inverted every k (here, k is a positive integer) pixels in the first direction X1, e.g., a one-by-one dot inversion, a two-by-one dot inversion, a three-by-one dot inversion, etc., and a one-by-two dot inversion. The second mode includes a column inversion in which the pixels have the same polarity as each other in the first direction X1 and the polarity of the pixels is inverted every pixel in the second direction.

The first output stage 412 of the first buffer circuit 341 receives the first driving voltage VDD and the second driving voltage VDD2ML and outputs a output signal thereof, e.g., a first output signal DO1, corresponding to the first and second differential signals PYk and NYk provided from the input stage 410 of the first buffer circuit 341 through the selection circuit 411 of the first buffer circuit 341. The second output stage 413 of the first buffer circuit 341 receives the third driving voltage VDD2MH and the fourth driving voltage VSS and outputs the first output signal DO1 corresponding to the first and second differential signals PYk and NYk provided from the input stage 410 of the first buffer circuit 341 through the selection circuit 411 of the first buffer circuit 341.

The second driving voltage VDD2ML applied to the first output stage 412 of the first buffer circuit 341 and the third driving voltage VDD2MH applied to the second output stage 413 of the first buffer circuit 341 have the voltage level between the first driving voltage VDD and the fourth driving voltage VSS. The second driving voltage VDD2ML and the third driving voltage VDD2MH may have the same voltage level as each other. In one exemplary embodiment, for example, the first driving voltage VDD has a voltage level of about 16 volts to about 18 volts and the fourth driving voltage VSS has a voltage level of about zero (0) volt. When the first driving voltage VDD has the voltage level of about 18 volts, the second driving voltage VDD2ML has the voltage level of about (9+α) volts and the third driving voltage VDD2MH has the voltage level of about (9−α) volts. In an alternative exemplary embodiment, the second driving voltage VDD2ML and the three driving voltage VDD2MH may have the same voltage level as each other, e.g., about 9 volts.

The switch 414 of the first buffer circuit 341 applies the first output signal DO1 from the first output stage 412 of the first buffer circuit 341 and the second output stage 413 of the first buffer circuit 341 to a corresponding data line, e.g., a first data line D1, in response to the line latch signal LOAD.

Figure 7:
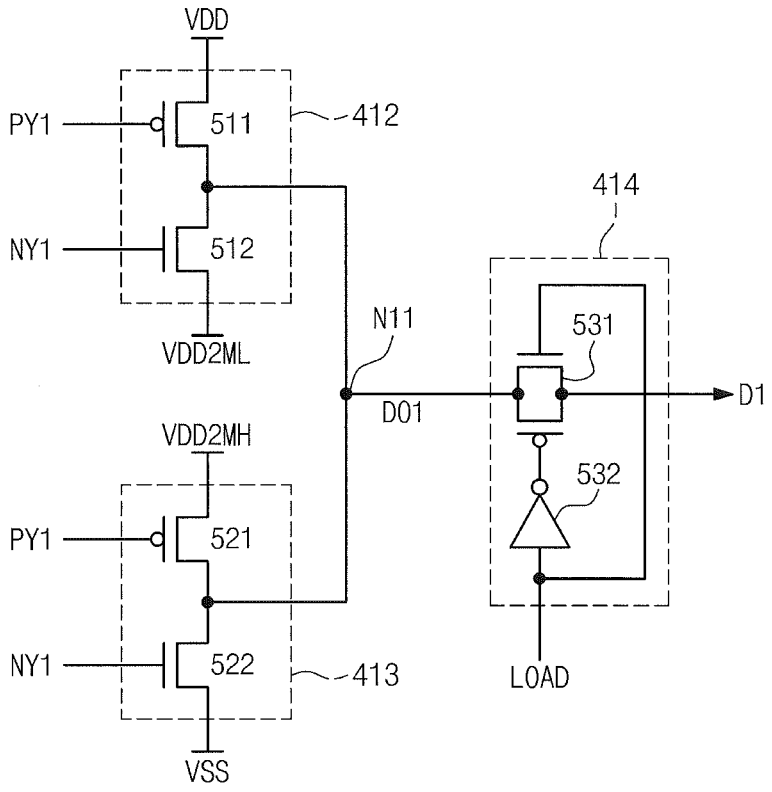
FIG. 7 is a circuit diagram showing circuit configurations of an exemplary embodiment of first and second output stages and a switch circuit of a first buffer circuit shown in FIG. 6.

FIG. 7 is a circuit diagram showing circuit configurations of an exemplary embodiment of the first and second output stages and the switch of the first buffer circuit shown in FIG. 6.

Referring to FIG. 7, the first output stage 412 includes a first transistor 511 and a second transistor 512. The first transistor 511 is connected between the first driving voltage VDD and an output node N11 and includes a gate terminal which receives the first differential signal PY1. The second transistor 512 is connected between the second driving voltage VDD2ML and the output node N11 and includes a gate terminal which receives the second differential signal NY1. The first output signal DO1 is output through the output node N11.

The second output stage 413 includes a third transistor 521 and a fourth transistor 522. The third transistor 521 is connected between the third driving voltage VDD2MH and the output node N11 and includes a gate terminal which receives the first differential signal PY1. The fourth transistor 522 is connected between the fourth driving voltage VSS and the output node N11 and includes a gate terminal which receives the second differential signal NY1. The first output signal DO1 is output through the output node N11.

The switch 414 includes a transmission gate 531 and an inverter 532. The transmission gate 531 is connected between the output node N11 and the first data line D1. The transmission gate 531 may include an n-type metal-oxide-semiconductor ("NMOS") transistor and a p-type metal-oxide-semiconductor ("PMOS") transistor. An NMOS gate terminal of the transmission gate 531 is connected to the line latch signal LOAD and a PMOS gate terminal of the transmission gate 531 is connected to an output terminal of the inverter 532. An input terminal of the inverter 532 is connected to the line latch signal LOAD. The switch 414 applies the first output signal DO1 to the corresponding data line, e.g., the first data line D1, in response to the line latch signal LOAD.

Figure 8:
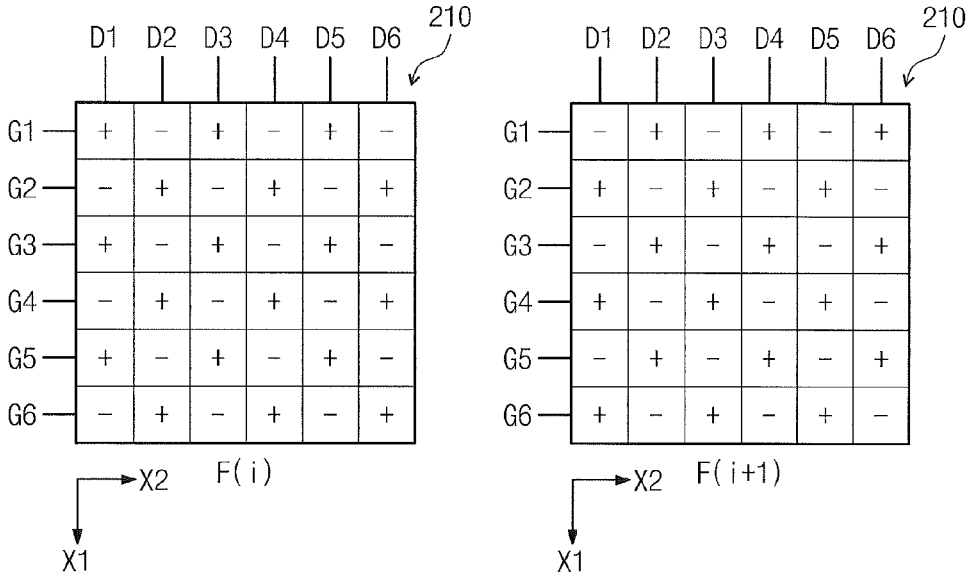
FIG. 8 is a view showing a portion of a display panel shown in FIG. 4 when the display panel is operated in a one-by-one dot inversion mode.

FIG. 8 is a view showing a portion of the display panel shown in FIG. 4 when the display panel is operated in the one-by-one dot inversion mode.

Referring to FIG. 8, the display panel 210 is operated in the one-by-one dot inversion mode in which the polarity of the pixels is inverted every pixel in the first direction X1 and the second direction X2. In an exemplary embodiment, the polarity of each pixel of the display panel 210 is inverted every frame in the one-by-one dot inversion mode. In such an embodiment, the pixel having a positive (+) polarity in an i-th frame F(i) has a negative (−) polarity in an (i+1)-th frame F(i+1), and the pixel having a negative (−) polarity in the i-th frame F(i) has a positive (+) polarity in the (i+1)-th frame F(i+1). In one exemplary embodiment, for example, the pixels connected to the first data line D1 and the gate lines, e.g., first to sixth gate lines G1 to G6, have the polarities of +, −, +, −, + and − in the i-th frame F(i), respectively, and have the polarities of −, +, −, +, − and + in the (i+1)-th frame F(i+1), respectively. Accordingly, when the display panel 210 is operated in the one-by-one dot inversion mode, a data line, e.g., the first data line D1, is inversely driven every horizontal period.

Figure 9:
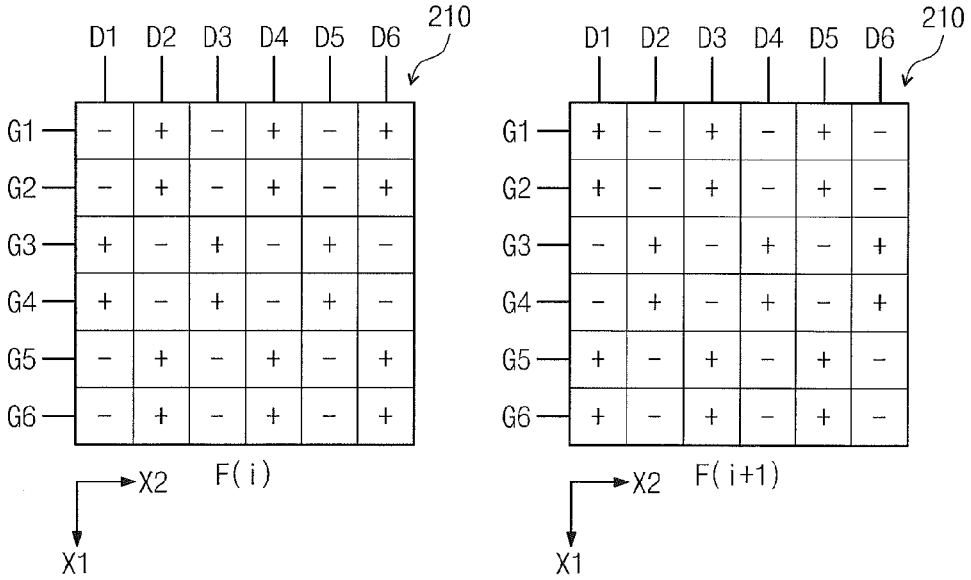
FIG. 9 is a view showing a portion of a display panel shown in FIG. 4 when the display panel is operated in a two-by-one dot inversion mode.

FIG. 9 is a view showing a portion of the display panel shown in FIG. 4 when the display panel is operated in the two-by-one dot inversion mode.

Referring to FIG. 9, the display panel 210 in the two-by-one dot inversion mode is operated to allow the polarity of the pixels of the display panel 210 to be inverted at every pixel in the second direction X2 and inverted at every two pixels in the first direction X1.

In such an embodiment, in the two-by-one dot inversion mode, the pixels connected to the first data line D1 and the gate lines G1 to G6 have the polarities of −, −, +, +, − and − in the i-th frame F(i), respectively, and have the polarities of +, +, −, −, + and + in the (i+1)-th frame F(i+1), respectively.

Figure 10:
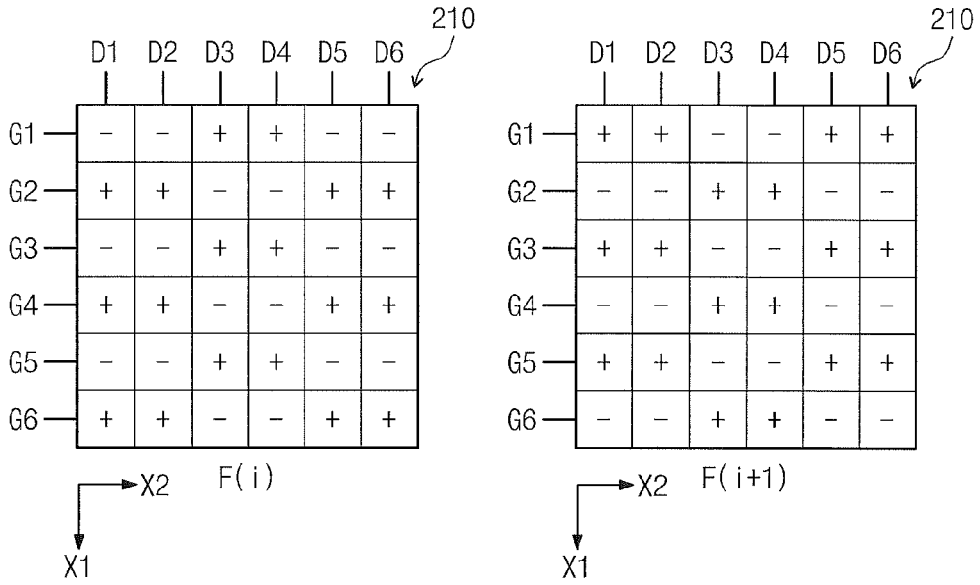
FIG. 10 is a view showing a portion of a display panel shown in FIG. 4 when the display panel is operated in a one-by-two dot inversion mode.

FIG. 10 is a view showing a portion of the display panel shown in FIG. 4 when the display panel is operated in the one-by-two dot inversion mode.

Referring to FIG. 10, the display panel 210 in the one-by-two dot inversion mode is operated to allow the polarity of the pixels of the display panel 210 to be inverted at every pixel in the first direction X1 and inverted at every two pixels in the second direction X2.

In such an embodiment, in the one-by-two dot inversion mode, the pixels connected to the first data line D1 and the gate lines G1 to G6 have the polarities of −, +, −, +, − and + in the i-th frame F(i), respectively, and have the polarities of +, −, +, −, + and − in the (i+1)-th frame F(i+1), respectively.

As described above, when the display panel 210 is operated in the two-by-one dot inversion mode or the one-by-two dot inversion mode as shown in FIGS. 9 and 10, the data line D1 is inversely driven every horizontal period.

Figure 11:
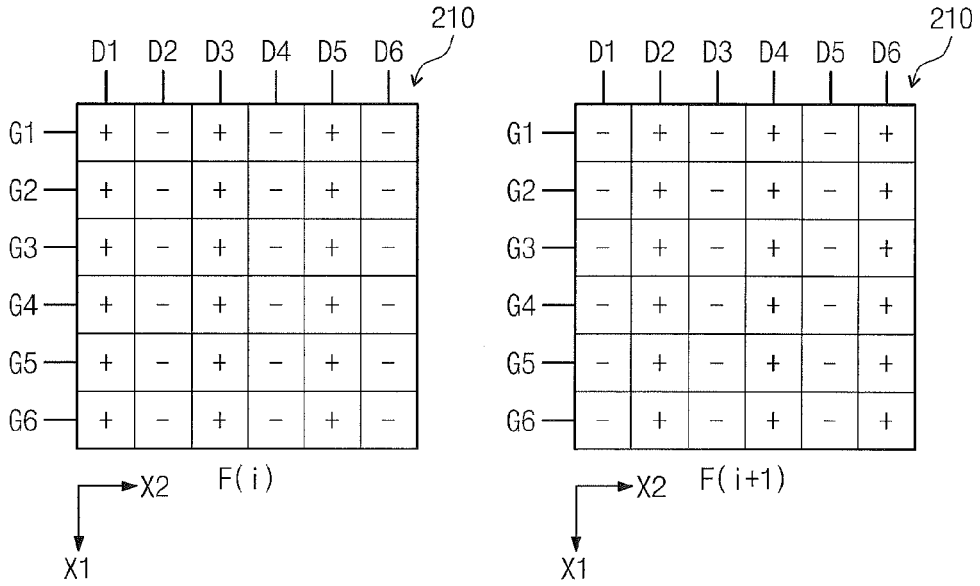
FIG. 11 is a view showing a portion of a display panel shown in FIG. 4 when the display panel is operated in a column inversion mode.

FIG. 11 is a view showing a portion of the display panel shown in FIG. 4 when the display panel is operated in the column inversion mode.

Referring to FIG. 11, the display panel 210 in the column inversion mode is operated such that the polarity of the pixels is inverted at every pixel in the second direction X2 and maintained at the same polarity in the first direction X1. In one exemplary embodiment, for example, when the pixel connected to the second data line D2 and the first gate line G1 is driven in the negative (−) polarity, the pixels connected to the first and third data lines D1 and D3 and the first gate line G1, which are adjacent to the pixel connected to the second data line D2 and the first gate line G1 in the second direction X1, are driven in the positive (+) polarity. In such an embodiment, the pixels arranged in the same column along the first direction X1 are driven with the same polarity and the polarity of each pixel is inverted at every frame. In such an embodiment, the pixels connected to the first data line D1 are driven in the positive (+) polarity during the i-th frame F(i) and driven in the negative (−) polarity during the (i+1)-th frame F(i+1), and the pixels connected to the second data line D2 are driven in the negative (−) polarity during the i-th frame F(i) and driven in the positive (+) polarity during the (i+1)-th frame F(i+1).

Figure 12:
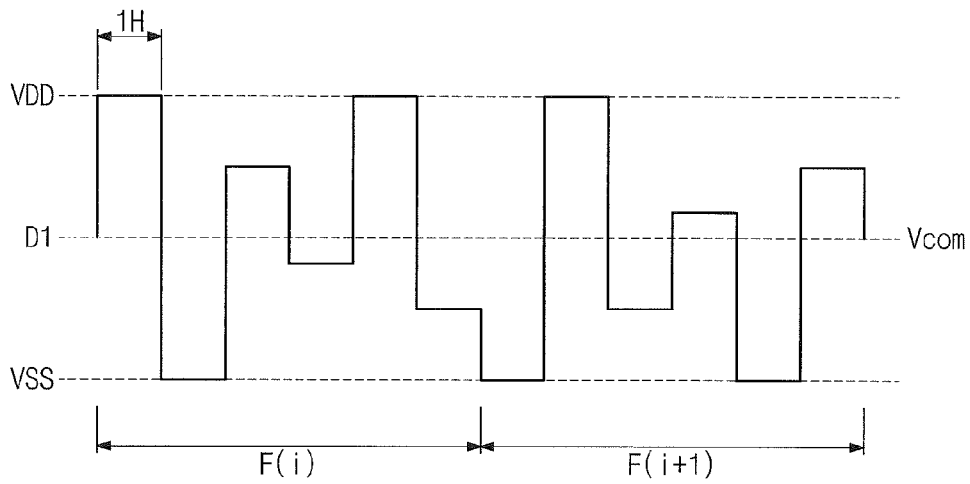
FIG. 12 is a view showing a variation of a voltage of a data line when the display panel shown in FIG. 8 is operated in a dot inversion mode.

FIG. 12 is a view showing a variation of a voltage of the data line when the display panel shown in FIG. 8 is operated in the one-by-one dot inversion mode.

Referring to FIG. 12, when the display panel 210 is operated in the one-by-one dot inversion mode, the first data line D1 is inversely driven in the positive (+) polarity and the negative (−) polarity with respect to the common voltage VCOM every one horizontal period 1H. In such an embodiment, the first data line D1 is driven by a voltage between the first driving voltage VDD and the fourth driving voltage VSS during all frames. Although not shown in FIG. 12, even though the display panel 210 is operated in the two-by-one or one-by-two dot inversion mode as shown in FIGS. 9 and 10, the data line D1 is inversely driven in the positive (+) polarity and the negative (−) polarity with respect to the common voltage VCOM every one horizontal period 1H. Therefore, the first data line D1 may be driven by the voltage between the first driving voltage VDD and the fourth driving voltage VSS during all frames.

Figure 13:
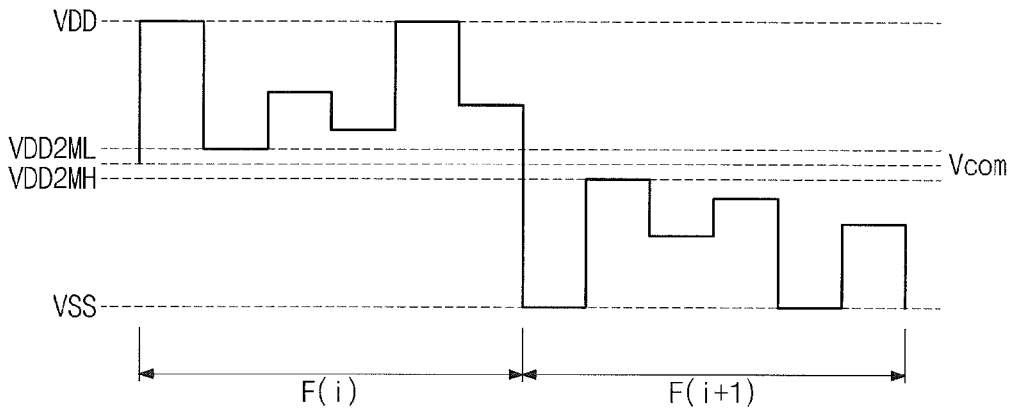
FIG. 13 is a view showing a variation of a voltage of a data line when the display panel shown in FIG. 11 is operated in a column inversion mode.

FIG. 13 is a view showing the variation of the voltage of the data line when the display panel shown in FIG. 11 is operated in the column inversion mode.

Referring to FIG. 13, when the display panel 210 is operated in the column inversion mode, the first data line D1 is inversely driven in the positive (+) polarity and the negative (−) polarity with respect to the common voltage VCOM every one frame. In such an embodiment, the first data line D1 is driven by a voltage between the first driving voltage VDD and the second driving voltage VDD2ML during the i-th frame F(i) and driven by a voltage between the third driving voltage VDD2MH and the fourth driving voltage VSS during the (i+1)-th frame F(i+1).

Figure 14:
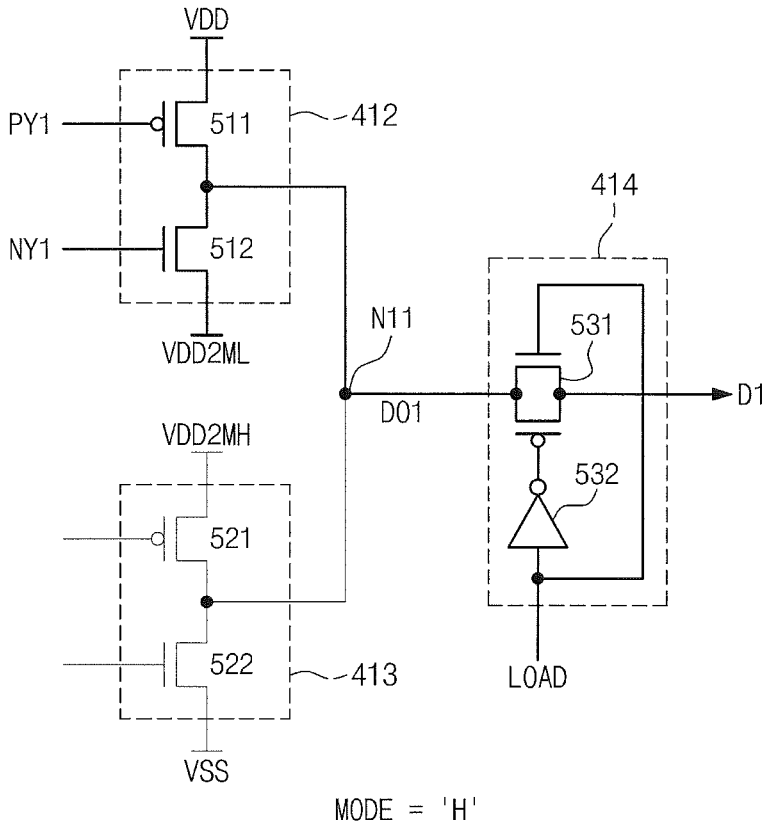
FIG. 14 is a circuit diagram illustrating operations of the first and second output stages and the switch circuit shown in FIG. 7 when the display panel shown in FIG. 8 is operated in the dot inversion mode.

FIG. 14 is a circuit diagram illustrating operations of the first and second output stages and the switch circuit shown in FIG. 7 when the display panel shown in FIG. 8 is operated in the first mode.

Referring to FIG. 14, when the display panel 210 is operated in the first mode, i.e., one of the line inversion mode, the one-by-one dot inversion mode and the two-by-one dot inversion mode, the mode signal MODE is set to the first level H. When the mode signal MODE is in the first level H, the selection circuit 411 shown in FIG. 6 outputs the first and second differential signals PY1 and NY1 from the input stage 410 to the first output stage 412. In response to the mode signal MODE, the voltage generator 230 shown in FIG. 4 outputs the ground voltage as the second driving voltage VDD2ML, and the voltage generator 230 outputs the ground voltage as the third driving voltage VDD2MH and the fourth driving voltage VSS.

The first output stage 412 receives the first and second differential signals PY1 and NY1 through the selection circuit 411 and outputs the first output signal DO1 corresponding to the first and second differential signals PY1 and NY1. In an exemplary embodiment, the voltage level of the first output signal DO1 is set between the first driving voltage VDD and the second driving voltage VDD2ML, which is set to be the ground voltage, as shown in FIG. 12. When the line latch signal LOAD is changed to the first level H, e.g., a high level, the first output signal DO1 is applied to the first data line D1 through the switch 414.

When the mode signal MODE is in the first level H that indicates the first mode, the first and second differential signals PY1 and NY1 are applied to only the first output stage 412 from the input stage 410 such that the buffer circuit 341 is operated in a rail-to-rail mode. In an alternative exemplary embodiment, the buffer circuit 341 may be configured to allow only the second output stage 413 to operate instead of the first output stage 412. In such an embodiment, the voltage generator 230 sets the third driving voltage VDD2MH applied to the second output stage 413 to the source voltage level and sets the first, second and fourth driving voltage VDD, VDD2ML and VSS applied to the second output stage 413 to the ground voltage level.

Figure 15:
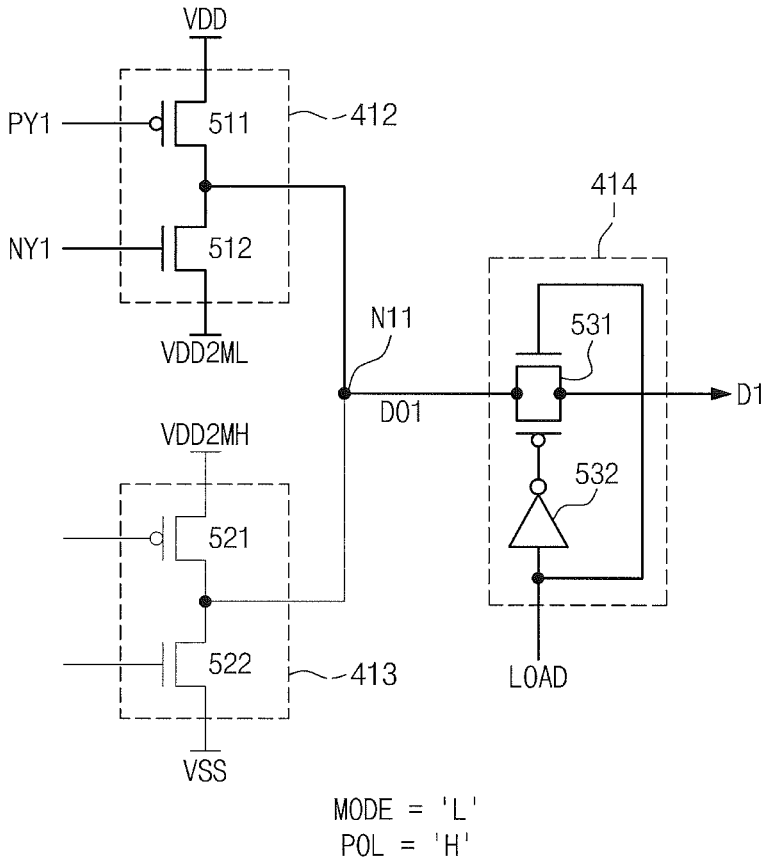
FIGS. 15 and 16 are circuit diagrams illustrating operations of the first and second output stages and the switch circuit shown in FIG. 7 when the display panel shown in FIG. 8 is operated in the column inversion mode.
Figure 16:
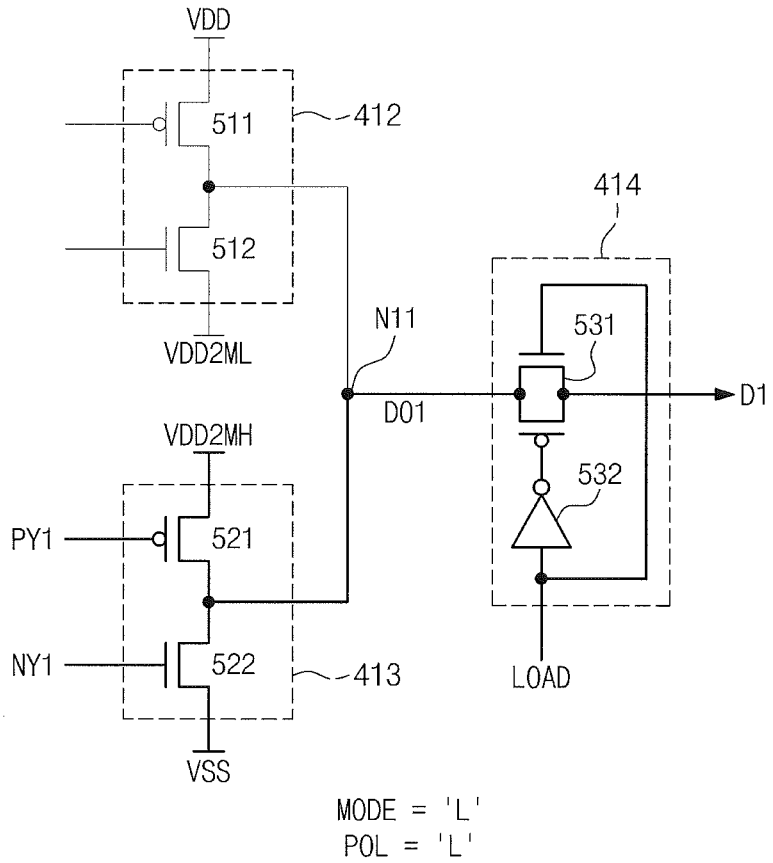

FIGS. 15 and 16 are circuit diagrams explaining operations of the first and second output stages and the switch circuit shown in FIG. 7 when the display panel shown in FIG. 8 is operated in the column inversion mode.

Referring to FIG. 15, when the display panel 210 is operated in the second mode, i.e., the column inversion mode, the mode signal MODE is set to the second level L. When the mode signal MODE is in the second level L, the selection circuit 411 shown in FIG. 6 alternately applies the first and second differential signals PY1 and NY1 provided from the input stage 410 to the first output stage 412 and the second output stage 413. The voltage generator 230 shown in FIG. 4 outputs the second driving voltage VDD2ML and the third driving voltage VDD2MH, which have the voltage level between the first driving voltage VDD of the source voltage level and the fourth driving voltage VSS of the ground voltage level, in response to the mode signal MODE. As described above, the voltage generator 230 may be configured to allow the second driving voltage VDD2ML and the third driving voltage VDD2MH to be output in different voltage levels or the same voltage level.

When the mode signal MODE is set to the second level L and the polarity inversion signal POL is set to the first level H, the selection circuit 411 applies the first and second differential signals PY1 and NY1 to the first output stage 412. The first output stage 412 receives the first and second differential signals PY1 and NY1 through the selection circuit 411 and outputs the first output signal DO1 corresponding to the first and second differential signals PY1 and NY1. In such an embodiment, the first output signal DO1 from the first output stage 412 has the voltage level between the first driving voltage VDD and the second driving voltage VDD2ML as shown in FIG. 13. When the line latch signal LOAD is in the first level H, e.g., the high level, the first output signal DO1 is applied to the first data line D1 through the switch 414.

Referring to FIG. 16, when the mode signal MODE is set to the second level L and the polarity inversion signal POL is set to the second level L, the selection circuit 411 applies the first and second differential signals PY1 and NY1 to the second output stage 413. The second output stage 413 receives the first and second differential signals PY1 and NY1 through the selection circuit 411 and outputs the output signal DO1 corresponding to the first and second differential signals PY1 and NY1. In such an embodiment, the first output signal DO1 from the second output stage 413 has the voltage level between the third driving voltage VDD2MH and the fourth driving voltage VSS as shown in FIG. 13. When the line latch signal LOAD is in the first level, e.g., the high level, the first output signal DO1 is applied to the first data line D1 through the switch 414.

In an exemplary embodiment, where the mode signal MODE is set to the second level L that indicates the column inversion mode, the first and second differential signals PY1 and NY1 from the input stage 410 are alternately applied to the first output stage 412 and the second output stage 413, and thus the buffer circuit is operated in a split rail mode.

In an exemplary embodiment, as described above, the data driver 260 may be applied not only to the display apparatus operated in the line inversion mode, the one-by-one dot inversion mode, or the two-by-one dot inversion mode but also the display apparatus operated in the column inversion mode.

Figure 17:
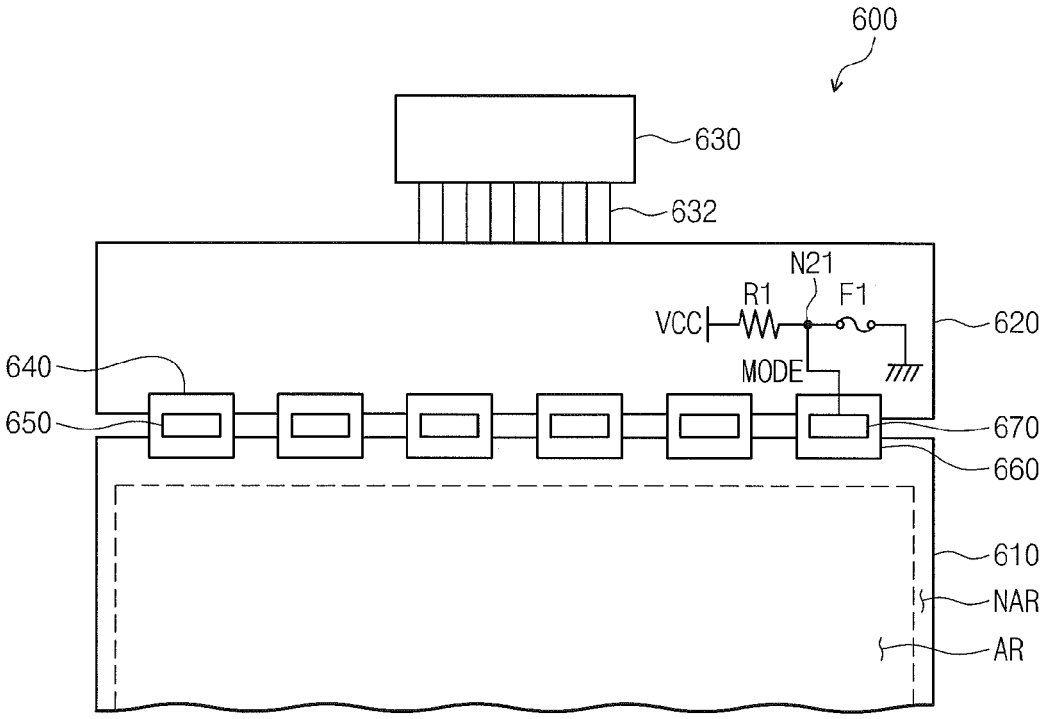
FIG. 17 is a block diagram showing an exemplary embodiment of a display apparatus having a function of setting a mode signal.

FIG. 17 is a block diagram showing an exemplary embodiment of a display apparatus having a function of setting a mode signal.

Referring to FIG. 17, a display apparatus 600 includes a display panel 610, a circuit board 620, a timing controller 630 and a plurality of data driving circuits 640 and 660.

The display panel 610 includes a display area AR in which a plurality of pixels is arranged and a non-display area NAR adjacent to the display area AR. The display area AR displays an image and the non-display area NAR does not display an image. The display panel 610 may include a glass substrate, a silicon substrate or a film substrate.

The circuit substrate 620 includes various circuits to drive the display panel 610. In an exemplary embodiment, the circuit substrate 620 includes a timing controller 630 and a plurality of wirings connected to the data driving circuits 640 and 660.

The timing controller 630 is electrically connected to the circuit substrate 620 through a cable 632. The timing controller 630 applies the image data DATA and the first control signal CONT1 to the data driving circuits 640 and 660.

In an exemplary embodiment, each of the data driving circuits 640 and 660 is realized by a TCP or a COF and a data driver integrated circuits 650 and 670 are mounted on each of the data driving circuits 640 and 660. Each of the data driver integrated circuits 650 and 670 drives the data lines in response to the image data DATA and the first control signal CONT1 from the timing controller 630. In an alternative exemplary embodiment, the data driver integrated circuits 650 and 670 may be directly mounted on the display panel 610 other than the circuit substrate 620.

Although not shown in FIG. 17, the display apparatus 600 can have a gate driving circuit. In an exemplary embodiment, the gate driving circuit is realized by a tape carrier package ("TCP") or a chip-on-film ("COF"), and a gate driving circuit is connected to a part of the display panel 610. In an alternative exemplary embodiment, the gate driving circuit may be realized by circuits using oxide semiconductor material, amorphous semiconductor material, crystalline semiconductor material, polycrystalline semiconductor material, etc. In this case, the gate driving circuit is integrated on the non-display area NAR of display panel 610.

In an exemplary embodiment, a fuse F1 and a resistor R1 are arranged on the circuit substrate 620. The resistor R1 is connected between a source voltage VCC and a node N21, and the fuse F1 is connected between the node N21 and a ground voltage. The node N21 is connected to the data driver integrated circuit 670 through the data driving circuit 660.

When the source voltage VCC is applied while the fuse F1 is unplugged, the voltage level at the node N21 raises to the level of the source voltage VCC. Therefore, the mode signal MODE is set to the first level, i.e., the high level. In such an embodiment, when the fuse F1 is plugged, the voltage level at the node N21 is maintained at the ground voltage. Thus, the mode signal MODE is set to the second level, i.e., the low level.

Accordingly, when the fuse F1 mounted on the circuit substrate 620 is selectively plugged in accordance with the operation mode of the display panel 610, the operation mode of the data driver integrated circuits 650 and 670 may be controlled.

Figure 18:
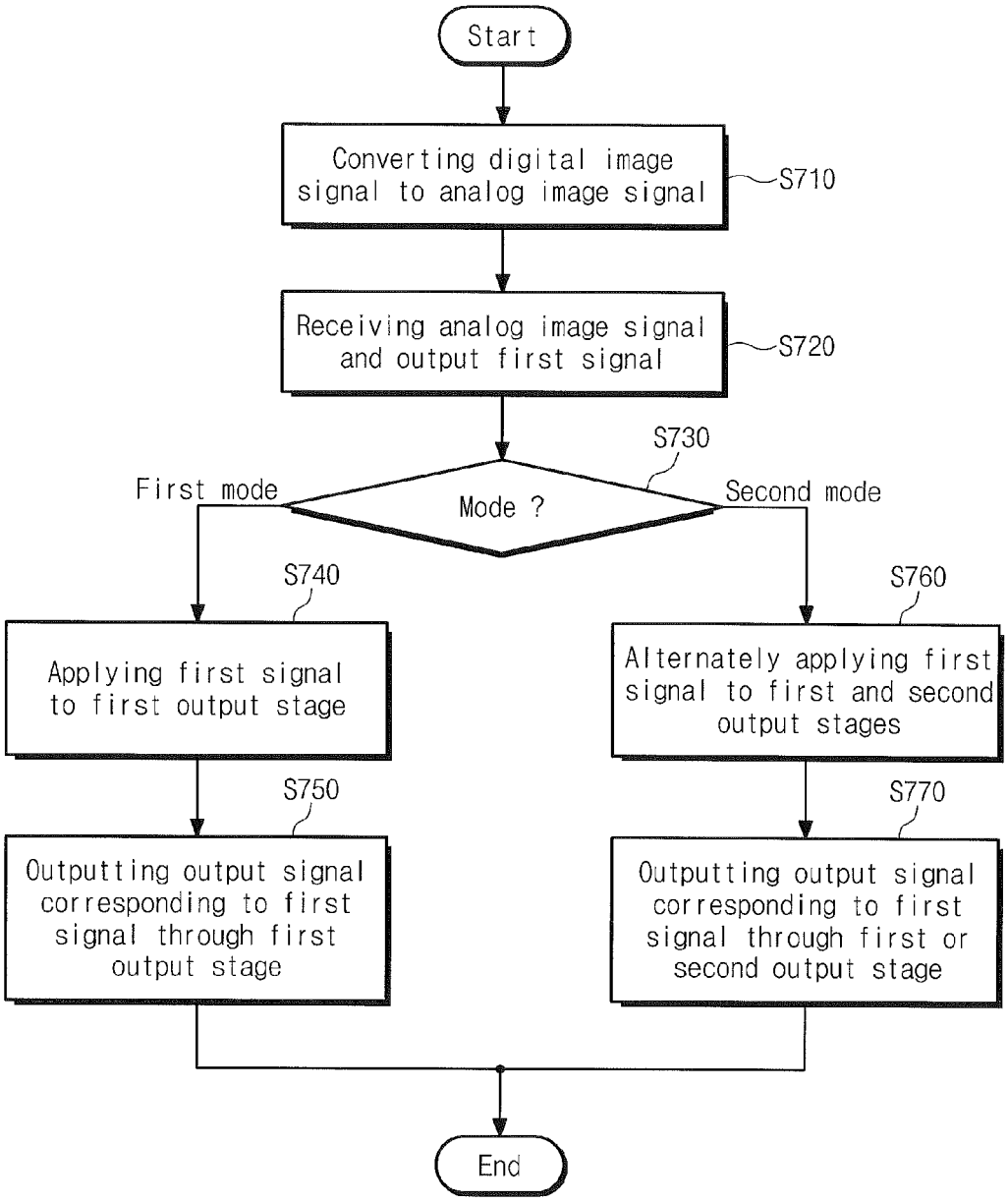
FIG. 18 is a flowchart showing an exemplary embodiment of a method of driving a display driving circuit according to the invention.

FIG. 18 is a flowchart showing an exemplary embodiment of a method of driving a display driving circuit according to the invention. For the convenience of description, the operation of the display driving circuit will be described with reference to the DA converter and the output buffer shown in FIG. 6, but the operation of the display driving circuit should not be limited to the configuration shown in FIG. 6.

Referring to FIGS. 6 and 18, the DA converter 330 outputs the analog image signals Y1 to Ym corresponding to the line latch image signals DA1 to DAm, which are digital signals, based on the gamma voltages VGMA1 to VGMAz (S710). The DA converter 330 applied to the display apparatus operated in the inversion mode includes the non-inverting DA converter 331, the inverting DA converter 332 and the output circuit 333. The non-inverting DA converter 331 outputs the non-inverting analog image signals respectively corresponding to the latch image signals DA to DAm from the latch part 320 shown in FIG. 5 based on the gamma voltages VGMA1 to VGMAz. The inverting DA converter 332 outputs inverting analog image signals respectively corresponding to the latch image signals DA to DAm from the latch part 320 shown in FIG. 5 based on the gamma voltages VGMA1 to VGMAz. The output circuit 333 outputs one of the non-inverting analog image signals from the non-inverting DA converter 331 and the inverting analog image signals from the inverting DA converter 332 as the analog image signals Y1 to Ym in response to the polarity inversion signal POL.

The output buffer 340 includes the buffer circuits 341 and 342. Each of the buffer circuits, e.g., the first buffer circuit 341, includes the input stage 410, the selection circuit 411, the first output stage 412, the second output stage 413 and the switch 414. Similarly, the second buffer circuit 342 includes the input stage 420, the selection circuit 421, the first output stage 422, the second output stage 423 and the switch 424.

The input stage 410 receives a corresponding analog image signal, e.g., the input stage 410 of the first buffer circuit 341 receives the first analog image signal Y1, and outputs the first signal (S720). The first signal includes the first and second differential signals PYk and NYk. The first differential signal PYk is the non-inversion differential signal and the second differential signal NYk is the inversion differential signal.

The selection circuit 411 applies the first and second differential signals PYk and NYk to one of the first and second output stages 412 and 413 in response to the mode signal MODE and the polarity inversion signal POL (S730). The selection circuit 411 applies the first and second differential signals PYk and NYk to the first output stage 412 (S740) when the mode signal MODE indicates the first mode, e.g., the line inversion or the dot inversion. When the mode signal MODE indicates the second mode, e.g., the column inversion, the selection circuit 411 alternately applies the first and second differential signals PYk and NYk to the first output stage 412 and the second output stage 413 in response to the polarity inversion signal POL (S760).

The first output stage 412 receives the first driving voltage VDD and the second driving voltage VDD2ML and outputs the first output signal DO1 corresponding to the first and second differential signals PY1 and NY1 provided from the input stage 410 through the selection circuit 411 (S750). The second output stage 413 receives the third driving voltage VDD2MH and the fourth driving voltage VSS and outputs the first output signal DO1 corresponding to the first and second differential signals PY1 and NY1 provided from the input stage 410 through the selection circuit 411 (S770).

The second driving voltage VDD2ML applied to the first output stage 412 and the third driving voltage VDD2MH applied to the second output stage 413 have the voltage level between the first driving voltage VDD and the fourth driving voltage VSS. The second driving voltage VDD2ML and the third driving voltage VDD2MH may have the same voltage level as each other.

Although the exemplary embodiments of the invention have been described, it is understood that the invention should not be limited to these exemplary embodiments but various changes and modifications can be made by one ordinary skilled in the art within the spirit and scope of the invention as hereinafter claimed.

What is claimed is:

1. A display driving circuit comprising:

a digital-to-analog converter configured to convert a digital image signal to an analog image signal; and a buffer circuit configured to receive the analog image signal and to output an output signal to a data line, wherein the buffer circuit comprises:

an input stage configured to receive the analog image signal and to output a first signal;

a first output stage configured to receive a first voltage and a second voltage and to output the output signal;

a second output stage configured to receive a third voltage and a fourth voltage and to output the output signal; and a selection circuit configured to apply the first signal from the input stage to the first output stage or the second output stage in response to a mode signal.

2. The display driving circuit of claim 1, wherein the selection circuit applies the first signal to the first output stage when the mode signal indicates a first mode, the first voltage is a source voltage when the mode signal indicates the first mode, and the second, third and fourth voltages are a ground voltage when the mode signal indicates the first mode.

3. The display driving circuit of claim 2, wherein the selection circuit alternately applies the first signal to the first output stage and the second output stage when the mode signal indicates a second mode, the first voltage is the source voltage when the mode signal indicates the second mode, the fourth voltage is the ground voltage when the mode signal indicates the second mode, and the second and third voltages have a voltage level between the source voltage and the ground voltage when the mode signal indicates the second mode.

4. The display driving circuit of claim 3, wherein the selection circuit alternately applies the first signal to the first output stage and the second output stage in response to a polarity inversion signal when the mode signal indicates the second mode.

5. The display driving circuit of claim 3, wherein the first mode is a column inversion mode, and the second mode is a dot inversion mode.

6. The display driving circuit of claim 1, wherein the digital-to-analog converter converts the digital image signal to a positive polarity analog image signal and a negative polarity analog image signal and applies one of the positive polarity analog image signal and the negative polarity analog image signal to the input stage in response to a polarity inversion signal.

7. The display driving circuit of claim 1, wherein the first signal output from the input stage comprises a first differential signal and a second differential signal.

8. The display driving circuit of claim 7, wherein the first output stage comprises:

a first transistor connected between the first voltage and an output node, and which receives the first differential signal; and a second transistor connected between the output node and the second voltage, and which receives the second differential signal, and the second output stage comprises:

a third transistor connected between the third voltage and the output node, and which receives the first differential signal; and a fourth transistor connected between the output node and the fourth voltage, and which receives the second differential signal.

9. The display driving circuit of claim 8, wherein the buffer circuit further comprises a switching circuit connected between the output node and the data line, wherein the switching circuit operates in response to a line latch signal.

10. A display apparatus comprising:

a plurality of gate lines;

a plurality of data lines crossing the gate lines;

a plurality of pixels connected to the gate lines and the data lines;

a gate driver configured to drive the gate lines;

a data driver configured to drive the data lines; and a timing controller configured to control the gate driver and the data driver in response to a first image signal and a control signal from an external device and to apply a second image signal to the data driver, wherein the data driver comprises:

a digital-to-analog converter configured to convert a digital image signal to an analog image signal; and a buffer circuit configured to receive the analog image signal and to output an output signal to the data lines, wherein the buffer circuit comprises:

an input stage configured to receive the analog image signal and to output a first signal;

a first output stage configured to receive a first voltage and a second voltage and to output the output signal;

a second output stage configured to receive a third voltage and a fourth voltage and to output the output signal; and a selection circuit configured to apply the first signal from the input stage to the first output stage or the second output stage in response to a mode signal.

11. The display apparatus of claim 10, further comprising:

a voltage generator configured to generate the first, second, third and fourth voltages.

12. The display apparatus of claim 11, wherein the selection circuit applies the first signal to the first output stage when the mode signal indicates a first mode, the first voltage generated by the voltage generator is a source voltage when the mode signal indicates the first mode, and the second, third and fourth voltages generated by the voltage generator are a ground voltage when the mode signal indicates the first mode.

13. The display apparatus of claim 11, wherein the selection circuit alternately applies the first signal to the first output stage and the second output stage when the mode signal indicates a second mode, the first voltage is a source voltage when the mode signal indicates the second mode, the fourth voltage is a ground voltage when the mode signal indicates the second mode, and the second and third voltages have a voltage level between the source voltage and the ground voltage when the mode signal indicates the second mode.

14. The display apparatus of claim 13, wherein the selection circuit alternately applies the first signal to the first output stage and the second output stage in response to a polarity inversion signal when the mode signal indicates the second mode.

15. A method of driving a display driving circuit, the method comprising:

converting a digital image signal to an analog image signal;

receiving the analog image signal to output a first signal;

applying the first signal to a first output stage or a second output stage in response to a mode signal;

outputting an output signal corresponding to the first signal using the first output stage when the first signal is applied to the first output stage; and outputting the output signal corresponding to the first signal using the second output stage when the first signal is applied to the second output stage, wherein the output signal output from the first output stage has a voltage level between a first voltage and a second voltage, and the output signal output from the second output stage has a voltage level between a third voltage and a fourth voltage.

16. The method of claim 15, wherein the applying the first signal to the first output stage or the second output stage comprises applying the first signal to the first output stage when the mode signal indicates a first mode, wherein the first voltage is a source voltage when the mode signal indicates the first mode, and the second, third and fourth voltages are a ground voltage when the mode signal indicates the first mode.

17. The method of claim 15, wherein the applying the first signal to the first output stage or the second output stage comprises alternately applying the first signal to the first output stage and the second output stage when the mode signal indicates a second mode, wherein the first voltage is a source voltage when the mode signal indicates the second mode, the fourth voltage is a ground voltage when the mode signal indicates the second mode, and the second and third voltages have a voltage level between the source voltage and the ground voltage when the mode signal indicates the second mode.

18. The method of claim 17, wherein the alternately applying the first signal to the first output stage and the second output stage when the mode signal indicates the second mode is performed in response to a polarity inversion signal.

* * * * *